US005450066A

United States Patent [19]

Brighenti et al.

[11] Patent Number: 5,450,066

[45] Date of Patent: Sep. 12, 1995

[54] FIRE ALARM HEAT DETECTOR

[75] Inventors: Donald D. Brighenti, Westminster; Lawrence G. Stanley, Templeton; Lawrence J. Feroli, West Townsend, all of Mass.

[73] Assignee: Simplex Time Recorder Company, Gardner, Mass.

[21] Appl. No.: 118,116

[22] Filed: Sep. 7, 1993

[51] Int. Cl.[6] ..... G08B 17/00

[52] U.S. Cl. ..... 340/589; 340/596; 374/133

[58] Field of Search ..... 340/589, 587, 588, 596, 340/584, 508, 507, 521–522, 693; 374/133, 121, 120, 102, 107, 163, 169; 364/557; 324/721; 219/510

[56] References Cited

U.S. PATENT DOCUMENTS

| | | | |
|---|---|---|---|
| 3,387,134 | 6/1968 | Treharne | 374/133 X |
| 3,518,654 | 6/1970 | Vassil | 340/589 X |
| 3,768,059 | 10/1973 | Day | 374/133 X |
| 3,896,423 | 7/1975 | Lindberg | 340/508 |
| 4,486,743 | 12/1984 | Brown | 340/584 |
| 4,722,612 | 2/1988 | Junkert et al. | 374/133 X |
| 4,863,279 | 9/1989 | Markel et al. | 340/584 X |
| 5,103,916 | 4/1992 | McLelland | 340/589 X |
| 5,254,975 | 10/1993 | Torikoshi | 340/589 |

OTHER PUBLICATIONS

System Sensor Brochure, "Fire Safety Devices," pp. 1–6 and 20 (back cover) (1993).

*Primary Examiner*—Brent Swarthout
*Assistant Examiner*—Thomas J. Mullen, Jr.
*Attorney, Agent, or Firm*—Hamilton, Brook, Smith & Reynolds

[57] ABSTRACT

An electronic heat detector provides a fire alarm with a rapid rate of rise of temperature. The rate of rise indication is obtained from a comparison of outputs from a first temperature sensor which responds rapidly to environmental temperature, referenced to a second temperature sensor which has an intermediate response between that of the first sensor and an electronics board. The second sensor is positioned within a protuberance from the heat detector housing.

17 Claims, 3 Drawing Sheets

FIRE ALARM HEAT DETECTOR

BACKGROUND

One form of detector used in fire alarm systems is a heat detector. Such detectors generally trigger an alarm not only when the actual temperature reaches some predetermined level but also when the rate of rise of temperature exceeds some level. A rapid rise in temperature can provide an early indication of some fire conditions.

Underwriters Laboratories rates heat detectors according to how quickly they respond to a rapid fire situation (UL 521). In order to minimize the number of detectors required in an environment, the detector should respond to a rapid fire condition in less than 30 seconds, and preferably less than 20 seconds. On the other hand, the detector should not be so sensitive that it indicates a fire condition at less than 130° F. where the rate of rise of temperature in the environment is no faster than 12° F. per minute.

The conventional heat detector includes a bimetallic temperature sensor mounted relative to a diaphragm on which an electrical contact is positioned. The diaphragm responds to a change in pressure between two chambers resulting from rapid changes in temperature of the air within the chambers. Such detectors are well understood and are reasonably accurate and inexpensive. However, they do suffer the expected changes in tolerance of mechanical components with age.

More recently, electronic heat detectors have been introduced. Such detectors respond to the difference in outputs of one temperature sensor exposed to the monitored environment and a reference temperature sensor mounted within the heat detector housing. To meet the Underwriters Laboratories tests, the expense of the required electronics has been such that the electronic heat detectors have not been price competitive with conventional mechanical detectors.

SUMMARY OF THE INVENTION

The present invention relates to an electronic heat detector with improved performance and which meets Underwriters Laboratories requirements with relatively simple circuitry such that the detector is price competitive with conventional mechanical devices.

In accordance with one aspect of the present invention, the heat detector comprises a housing having electronics mounted on at least one board therein for providing a rate of temperature rise output in response to a difference between first and second environmental temperature indications. A first temperature sensor is exposed to the environment surrounding the housing to provide a first environmental temperature indication with a fast response to change in environmental temperature. A second temperature sensor is positioned to provide a reference environmental temperature indication. The second sensor has a response to change in environmental temperature which is slow relative to the fast response of the first environmental temperature indication but which is fast relative to the temperature response of the electronics board to changes in environmental temperature. In particular, the second temperature sensor is positioned within a protuberance from the housing. That location provides sufficient exposure of the sensor within a sufficiently small thermal mass that the second sensor follows the temperature of the environment with a delay which is substantially less than the delay of the electronics board.

As a result of this intermediate positioning of the second sensor, a single alarm set point can be used in a comparison between the two temperature indications to reliably meet the Underwriters Laboratories tests with any rate of rise. In particular, an alarm set point is at least equal to the temperature differential between the sensors 5 minutes after a 12° per minute rate of rise in environmental temperature. With a rapid increase in temperature of about 50° in a fire test, that set point is reached in less than 30 seconds, and preferably less than 20 seconds.

The heat detector should also include a comparator which provides an alarm when the temperature of the first sensor alone reaches some predetermined threshold. Thresholds of 135° F. and 200° F. have been used in the past for different applications. The preferred temperature sensors are thermistors.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
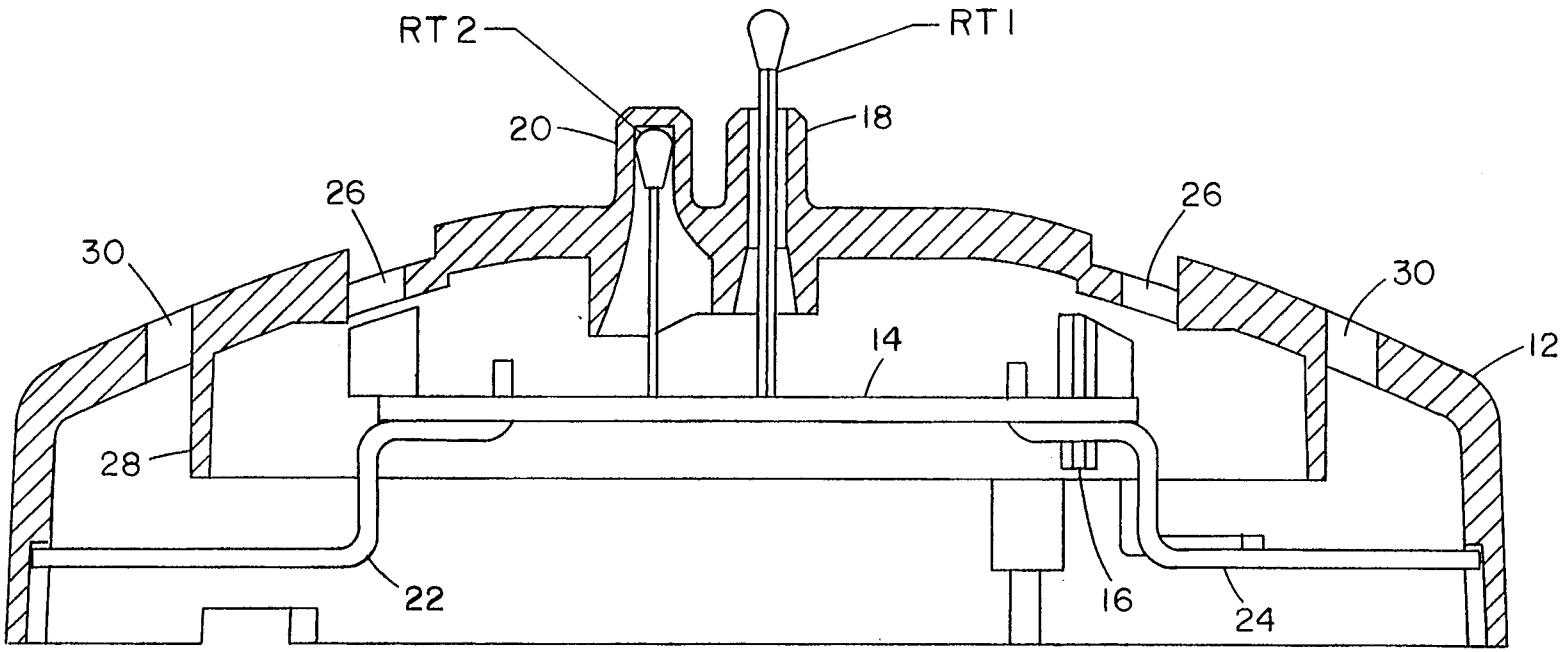
FIG. 1 is a cross-sectional view of a heat detector embodying the present invention.

FIG. 1 is a cross-sectional view of a heat detector embodying the present invention. The detector comprises a housing 12 of plastic material in which an electronic circuit board 14 is seated. The circuit board is retained on plastic protrusions, including protrusion 16, extending from the housing through holes in the board. Electrical contact to the circuit board is made through two leads 22 and 24.

A thermistor RT1 extends from the board 14 through a protruding port 18 into the environment to be detected. In the usual application, the detector would be mounted to a ceiling and would thus be inverted from the orientation shown in FIG. 1. A second thermistor RT2 provides a reference temperature for setting a rate of rise alarm as discussed in detail below. In accordance with the present invention, the thermistor RT2 is positioned within a protuberance 20 from the housing 12. It is there exposed to the environment through thin plastic forming the protuberance which presents a large surface area per mass. At that location, the thermistor RT2 does not follow the environmental temperatures as closely as RT1, but it does follow that temperature substantially more closely than does the board 14.

Holes 26 are provided about a circle in the housing 12 for mounting of a cage which is not shown. The cage protects the exposed thermistor RT1 from impact yet allows free flow of air from the environment past the thermistor RT1 and protuberance 20. Vent holes 30 are also provided in the housing. Once assembled, the region of the housing within flange 28 is filled with potting material.

Figure 2:
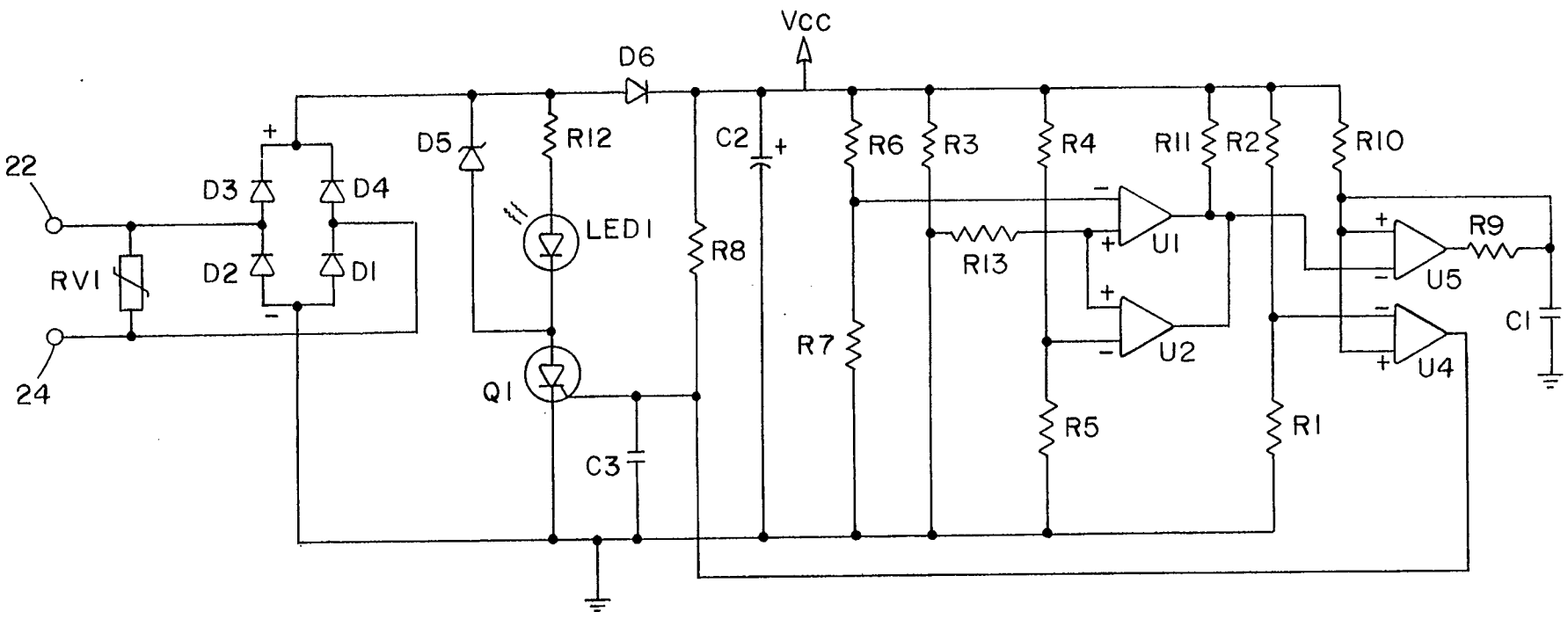
FIG. 2 is an electrical schematic of the heat detector electronics mounted within the detector of FIG. 1.

The electronics mounted to the circuit board 14 are illustrated in FIG. 2. The two leads 22 and 24 provide the sole electrical connection to the detector from an alarm monitor which monitors many heat detectors and other fire detectors in the system. The alarm condition of the detector is also sensed through the leads 22 and 24.

A transient surge protection varistor RV1 is provided across the leads 22, 24 leading into four diodes D1, D2, D3 and D4 which form a full bridge rectifier. The bridge rectifier allows the DC input applied to leads 22 and 24 to be coupled in either polarity. The input voltage is applied through diode D6 to a capacitor C2 which serves to filter the Vcc supply of the detector.

A fixed temperature comparator U1 receives a reference voltage from the voltage divider of resistors R6 and R7. The second input to comparator U1 is the environmental temperature indication from the voltage divider of resistor R3 and the thermistor RT1. That indication is supplied to comparator U1 through a transient suppression resistor R13. A second comparator U2 makes the rate of rise comparison. It receives as a reference the temperature indication from the voltage divider of resistor R4, thermistor RT2 and resistor R5. Comparator U2 triggers an alarm when the exposed temperature of RT1 reaches some threshold above the temperature of RT2 due to rapid increase of the environmental temperature as discussed in detail below.

The outputs of the comparators U1 and U2 are ordinarily held at Vcc through resistor R11. When either U1 or U2 reaches its threshold differential, its output pulls the input to comparator U3 to zero volts. Until the alarm condition, U3 normally holds its output low so that there is a voltage drop through R10 to zero volts on C1. With an alarm condition, the output of U3 goes high to charge capacitor C1 through resistor R9. After three seconds, the voltage on capacitor C1 reaches a threshold voltage of comparator U4. Thus, a circuit including comparator U3 serves as a noise filter which assures that there is an alarm condition for at least three seconds before triggering an alarm.

The reference input to comparator U4 is taken from the voltage divider of the resistors R2 and R1. When U4 is triggered by charging of capacitor C1, its normally zero volt output is raised to Vcc through resistor R8. With charging of capacitor C3 through R8, SCR Q1 is gated on to draw current through resistor R12 and light-emitting diode LED1. LED1 provides a local visual indication of the alarm condition. Further, the current drawn through SCR Q1 is drawn through leads 22 and 24 and is sensed at the central monitor. A zener diode D5 is provided across the light-emitting diode to protect the LED from over voltage. The SCR Q1 conducts until the central controller turns off power through leads 22 and 24.

Figure 4:
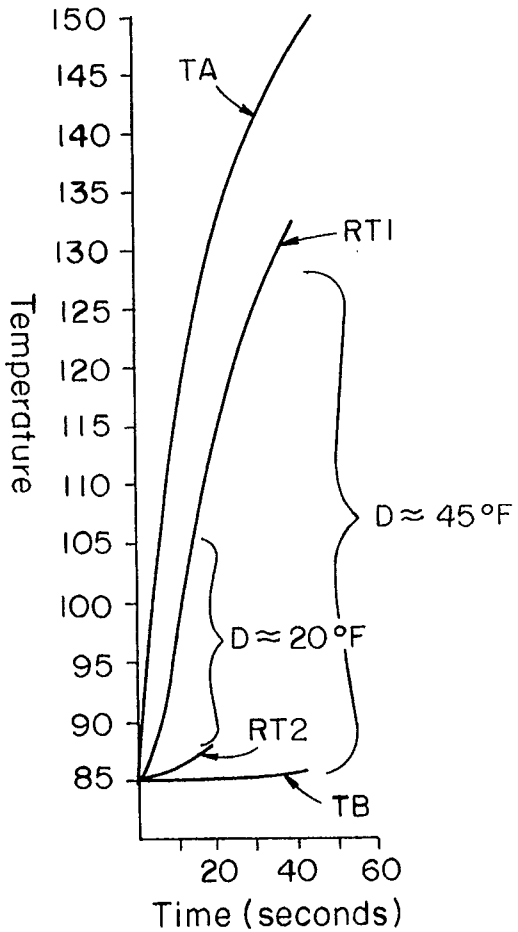
FIG. 4 illustrates the temperatures of FIG. 3 in a fire test.

It can be seen from the above description that the circuit of FIG. 2 is an exceptionally simple circuit with a single comparator U1 for monitoring fixed temperature and a single comparator U2 for monitoring rate of rise, the outputs of those comparators being combined through U3 and U4 to gate the SCR Q1. As explained below with respect to FIGS. 3 and 4, without the novel positioning of thermistor RT2 at an intermediate position between the circuit board and the environment, much more complex circuitry would be required in order to meet the performance of the disclosed detector.

Figure 3:
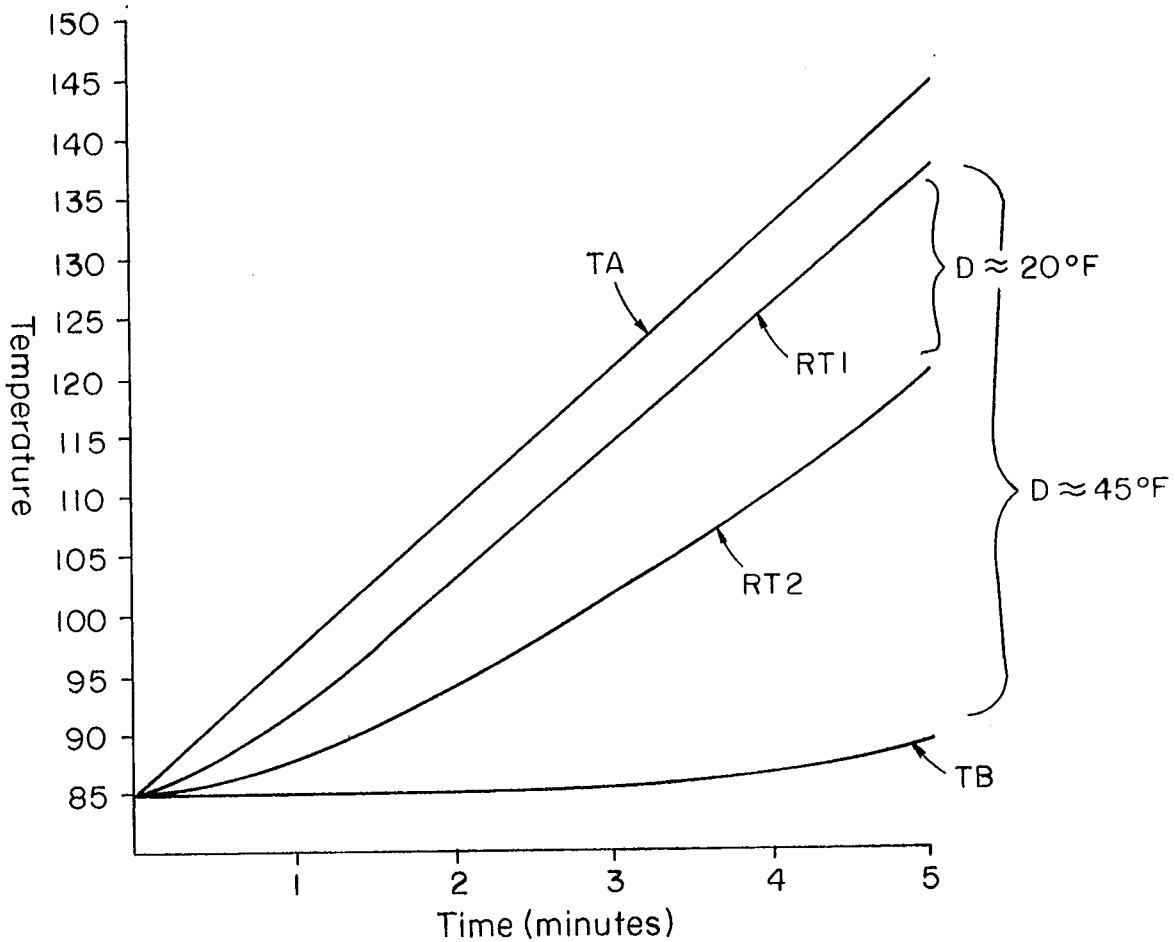
FIG. 3 illustrates temperature versus time for the temperature detectors of FIG. 1 relative to the electronic circuit board temperature in a 12° F./minute rate of rise test.

FIG. 3 illustrates response of the assembly of FIG. 1 to a 12° F./minute rate of rise test performed by Underwriters Laboratories. In that test, the ambient temperature TA is caused to rise at a rate of 12° F./minute from 85°. This test is intended to assure that false alarms are not given with such a moderate rate of rise in temperature so long as the temperature of the environment has not exceeded 130°. The temperature indications provided by RT1 and RT2 are illustrated in FIG. 3, as is the actual temperature TB of the electronic circuit board. Although the ambient temperature would reach 130° F. in less than four minutes in this test, the system is designed at five minutes to provide some level of tolerance in the test.

In a conventional electronic heat detector, the temperature difference which would be monitored in a rate of rise test would be the difference between RT1 and the temperature TB of the board since the reference thermistor would be mounted directly to the board. Thus, to pass the rate of rise test in this situation, the threshold required to avoid triggering the rate of rise alarm at five minutes would have to be at least D=45° F. as illustrated in FIG. 3. With the present design, however, where the reference thermistor RT2 is positioned to more closely follow the environmental temperature TA, the detector can pass the rate of rise test with an alarm set point of D of only about 20° F. This lesser threshold is significant when one considers the fire test illustrated in FIG. 4.

In the fire test, the detector is exposed to a flash fire which results in a very rapid increase in temperature TA. If in this test one uses the same alarm set point D equal to 20° F. taken from FIG. 3, it can be seen that an alarm condition is reached at about 107° F. in 15 seconds; whereas, with a set point of 45° F. the fire is not detected until about 130° F. in 36 seconds. The more rapid response of the detector of the present invention is obtained with the lower threshold even though the temperature of RT2 has risen somewhat above the temperature TB of the board. The temperature response of RT2 is sufficiently delayed to provide a rapid detection with a quick rate of rise; it is sufficiently responsive to ambient temperature so as not to trigger false alarms with the more moderate rate of rise of FIG. 3.

A detector having the reference thermistor mounted to the electronic circuit board can be caused to match the response of the detector of the present invention with both rapid and moderate rates of rise in temperature by utilizing a more complex circuit which requires different comparisons at different rates of rise. In accordance with the present invention, by merely repositioning the reference thermistor, a single comparison using a single threshold can be used to pass the Underwriters Laboratories tests and obtain improved quick response time on the rapid rate of rise test. With the quick response, Underwriters Laboratories will allow greater spacing of detectors in a building (e.g., 70 feet).

A further benefit of positioning the reference thermistor RT2 in the protuberance is that it is not so affected by the temperature behind the ceiling to which the heat detector is attached. A heat detector that has a referenced thermistor mounted to the PC board will, in steady state conditions, be more responsive to the temperature above the ceiling than to the temperature within the room. It is not uncommon to see a difference in temperature of 30° F. between the room temperature and the crawl space above the ceiling, and the detector would likely be connected to an electrical box through which it would be exposed to crawl space temperature. If the temperature were hotter above the ceiling, the temperature of RT1 would have to overcome that temperature differential before triggering an alarm, so the detector would be significantly less responsive to rate of temperature rise. On the other hand, if the temperature above the ceiling were colder than the temperature of the room, the rate of rise comparator would become too sensitive and would produce false alarms. This problem is compounded when the air pressure above the ceiling is higher than the air pressure in the room, forcing the air above the ceiling to blow into the back of the detector.

With the present invention, because thermistor RT2 is removed from the main body of the detector and is exposed to the environmental temperature of the room, the problem of a different temperature above the ceiling is reduced.

While this invention has been particularly shown and described with references to preferred embodiments thereof, it will be understood by those skilled in the art that various changes in form and details may be made therein without departing from the spirit and scope of the invention as defined by the appended claims. For example, though thermistors are the preferred temperature sensors, other sensors may be used, and the comparators need not be discrete integrated circuit devices.

What is claimed is:

1. An environmental heat detector comprising:

a housing;

electronics on a board within the housing for providing a rate of temperature rise output in response to a difference between first and second environmental temperature signals;

a first temperature sensor exposed to the environment surrounding the housing to provide the first environmental temperature signal with a fast response to change in environmental temperature;

a second temperature sensor positioned to provide the second environmental temperature signal with a response to change in environmental temperature which is slow relative to the fast response of the first temperature signal but which is fast relative to the temperature response of the electronics board to change in environmental temperature.

2. A heat detector as claimed in claim 1 wherein the second temperature sensor is positioned within a protuberance of the housing.

3. A heat detector as claimed in claim 1 where an alarm set point, at least equal to the temperature difference between the first and second temperature sensors after the heat detector is exposed to five minutes of a 12° F./minute rate of rise in environmental temperature, is reached in less than 20 seconds with an increase in temperature of about 50° in 20 seconds.

4. A heat detector as claimed in claim 1 wherein the electronics provide a rate of rise alarm indication from a single comparison of the first and second temperature signals and, in operation, the detector passes Underwriters Laboratories' UL521 fire test by responding to a rapid fire condition in less than 30 seconds and not indicating a fire condition at less than 130° F. where the rate of rise of environmental temperature is no faster than 12° F. per minute.

5. A heat detector as claimed in claim 4 which triggers an alarm in the fire test in less than 20 seconds.

6. A heat detector as claimed in claim 1 wherein the electronics further provide an alarm indication when the first temperature signal reaches a predetermined threshold.

7. A heat detector as claimed in claim 1 wherein the electronics comprises a single comparator for making a rate of rise comparison between the first and second temperature signals.

8. A heat detector as claimed in claim 1 wherein the temperature of the second temperature sensor is closer to the temperature of the first temperature sensor than it is to the temperature of the electronics board after the heat detector is exposed for five minutes to a 12° F./minute rate of environmental temperature rise.

9. An environmental heat detector comprising:

a housing;

electronics on a board within the housing for providing a rate of temperature rise output in response to a difference between first and second environmental temperature signals;

a first temperature sensor exposed to the environment surrounding the housing to provide the first environmental temperature signal with a fast response to change in environmental temperature;

a second temperature sensor positioned within a protuberance of the housing to provide the second environmental temperature signal with a response to change in environmental temperature which is closer to that of the first temperature sensor than to that of the electronics board after the heat detector is exposed for five minutes to a 12° F./minute rate of environmental temperature rise;

wherein the electronics comprises:

a first comparator for providing a rate of rise alarm indication from a comparison of the first and second temperature signals, the comparator having a set point, at least equal to the temperature difference between the first and second temperature sensors after the heat detector is exposed to five minutes of a 12° F./minute rate of rise in environmental temperature, which is reached in less than 20 seconds with an increase in temperature of about 50° in 20 seconds; and a second comparator for providing an alarm indication when the first temperature signal reaches a predetermined threshold.

10. A method of detecting rate of rise of temperature in an environment to trigger an alarm comprising:

providing electronics within a housing on at least one electronics board, the electronics responding to first and second environmental temperature signals to provide a rate of rise alarm indication;

providing a first environmental temperature signal with a fast response to change in environmental temperature;

providing a second environmental temperature signal with a response to change in environmental temperature which is slow relative to the fast response of the first environmental temperature signal but which is fast relative to the response of temperature of the at least one electronics board to change in environmental temperature; and providing by means of the electronics a rate of rise alarm indication with a rapid rise in temperature of the first temperature signal relative to the second temperature signal.

11. A method as claimed in claim 10 wherein the second environmental temperature signal is obtained from a temperature sensor mounted within a protuberance of a detector housing.

12. A method as claimed in claim 10 where an alarm set point, at least equal to the temperature difference between the first and second temperature sensors after the housing is exposed to five minutes of a 12° F./minute rate of rise in environmental temperature, is reached in less than 20 seconds with an increase in temperature of about 50° in 20 seconds.

13. A method as claimed in claim 10 wherein the electronics are embodied in a heat detector, the rate of rise alarm indication is provided from a single comparison of the first and second temperature signals, and the heat detector in operation passes Underwriters Laboratories' UL521 fire test by responding to a rapid fire condition in less than 30 seconds and not indicating a fire condition at less than 130° F. where the rate of rise of environmental temperature is no faster than 12° F. per minute.

14. A method as claimed in claim 13 wherein the rate of rise alarm indication is provided in the fire test in less than 20 seconds.

15. A method as claimed in claim 10 further comprising providing an alarm indication when the first temperature signal reaches a predetermined threshold.

16. A method as claimed in claim 10 wherein the rate of rise alarm indication is provided from a single comparison between the first and second temperature signals.

17. A method as claimed in claim 10 wherein the second temperature signal is closer to the first temperature signal than it is to temperature of the at least one electronics board after the housing is exposed for five minutes to a 12° F./minute rate of environmental temperature rise.

* * * * *